US006892738B2

(12) United States Patent
Bran et al.

(10) Patent No.: US 6,892,738 B2
(45) **Date of Patent: *May 17, 2005**

(54) APPARATUS AND METHODS FOR REDUCING DAMAGE TO SUBSTRATES DURING MEGASONIC CLEANING PROCESSES

(75) Inventors: Mario E. Bran, Garden Grove, CA (US); Michael B. Olesen, Yorba Linda, CA (US); Yi Wu, Irvine, CA (US)

(73) Assignee: Goldfinger Technologies, LLC, Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/760,596

(22) Filed: Jan. 20, 2004

(65) Prior Publication Data

US 2004/0168707 A1 Sep. 2, 2004

Related U.S. Application Data

(63) Continuation of application No. 09/922,509, filed on Aug. 3, 2001, now Pat. No. 6,679,272.

(51) Int. Cl.[7] ..... C25F 5/00

(52) U.S. Cl. ..... 134/1.3; 134/34; 134/137; 134/148; 134/151; 134/153; 134/184; 134/198; 134/902; 310/311; 310/320; 310/367; 310/368; 310/369; 310/370; 438/906

(58) Field of Search ..... 134/1.3, 34, 137, 134/148, 151, 153, 184, 198, 902, 1; 310/311, 320, 367, 368, 369, 370; 438/906

(56) References Cited

U.S. PATENT DOCUMENTS

| | | | | | |
|---|---|---|---|---|---|
| 4,401,131 | A | * | 8/1983 | Lawson | 134/149 |
| 4,537,511 | A | * | 8/1985 | Frei | 366/127 |
| 5,975,098 | A | | 11/1999 | Yoshitani et al. | |
| 6,021,785 | A | | 2/2000 | Grutzediek et al. | |
| 6,039,059 | A | | 3/2000 | Bran | |
| 6,140,744 | A | | 10/2000 | Bran | |
| 6,295,999 | B1 | * | 10/2001 | Bran | 134/1.3 |
| 6,524,251 | B2 | | 2/2003 | Rabiner et al. | |
| 6,568,408 | B2 | | 5/2003 | Mertens et al. | |
| 2004/0020512 | A1 | * | 2/2004 | Hosack et al. | 134/1.3 |

FOREIGN PATENT DOCUMENTS

| | | |
|---|---|---|
| EP | 0 044 800 | 1/1982 |

* cited by examiner

*Primary Examiner*—M. Kornakov
(74) *Attorney, Agent, or Firm*—Michael B. Fein; Brian L. Belles; Cozen O'Connor, P.C.

(57) ABSTRACT

The present invention provides a megasonic cleaning apparatus configured to provide effective cleaning of a substrate without causing damage to the substrate. The apparatus includes a probe having one of a variety of cross-sections configured to decrease the ratio of normal-incident waves to shallow-angle waves. One such cross-section includes a channel running along a portion of the lower edge of the probe. Another cross-section includes a narrow lower edge of the probe. Another cross-section is elliptical. Another cross-section includes transverse bores originating in the lower edge of the probe. As an alternative to, or in addition to, providing a probe having a cross-section other than circular, the present invention may also provide a probe having a roughened lower surface.

40 Claims, 7 Drawing Sheets

APPARATUS AND METHODS FOR REDUCING DAMAGE TO SUBSTRATES DURING MEGASONIC CLEANING PROCESSES

RELATED APPLICATION

This application is a continuation of application Ser. No. 09/922,509, filed on Aug. 3, 2001, now U.S. Pat. No. 6,679,272 the entire contents of which are hereby expressly incorporated by reference.

BACKGROUND OF THE INVENTION

1. Field of the Invention

This invention relates to apparatus and methods for cleaning semiconductor wafers or other such items requiring extremely high levels of cleanliness. More particularly, the present apparatus and methods relate to megasonic cleaners configured to prevent damage to delicate devices on a wafer.

2. Description of the Related Art

Semiconductor wafers are frequently cleaned in cleaning solution into which megasonic energy is propagated. Megasonic cleaning systems, which operate at a frequency over twenty times higher than ultrasonic, safely and effectively remove particles from materials without the negative side effects associated with ultrasonic cleaning.

Megasonic energy cleaning apparatuses typically comprise a piezoelectric transducer coupled to a transmitter. The transducer is electrically excited such that it vibrates, and the transmitter transmits high frequency energy into liquid in a processing tank. The agitation of the cleaning fluid produced by the megasonic energy loosens particles on the semiconductor wafers. Contaminants are thus vibrated away from the surfaces of the wafer. In one arrangement, fluid enters the wet processing container from the bottom of the tank and overflows the container at the top. Contaminants may thus be removed from the tank through the overflow of the fluid and by quickly dumping the fluid.

As semiconductor wafers have increased in diameter, first at 200 mm and now at 300 mm, the option of cleaning one wafer at a time has become more desirable. A single large diameter wafer, having a multitude of devices on it, is more valuable than its smaller diameter counterpart. Larger diameter wafers therefore require greater care than that typically employed with batch cleaning of smaller wafers.

Verteq, Inc. of Santa Ana, Calif. has developed in recent years a megasonic cleaner in which an elongated probe is positioned in close proximity to the upper surface of a horizontally mounted wafer. Cleaning solution applied to the wafer produces a meniscus between the probe and the wafer. Megasonic energy applied to an end of the probe produces a series of vibrations of the probe along its length that are directed towards the wafer through the meniscus. Producing relative movement between the probe and the wafer, such as by rotating the wafer, has been found to be an effective way to loosen particles over the entire surface of the wafer, causing them to be washed away from the rotating wafer. An example of such an arrangement is illustrated in U.S. Pat. No. 6,140,744, assigned to Verteq, Inc, the entirety of which is incorporated herein by reference.

Such a system provides very effective cleaning. However, as the height and density of deposition layers on wafers have increased, so has the fragility of such wafers. Current cleaning methods, including those using the system of the '744 patent, can result in damage to delicate devices on the wafers. Such damage is, of course, a serious issue, because of the value of each wafer after layers of highly sophisticated devices have been deposited on the wafer. Thus, a need exists to improve the cleaning capability of such a megasonic probe system in a manner that will reduce the risk of damage to these delicate devices.

Through testing, Verteq, Inc. has determined that the extent of damage caused to each wafer is directly proportional to the power, or sonic watt density, applied to the probe. Damage can be reduced, then, by applying lower power. Testing has also shown, however, that reducing power may not be the best solution to the wafer damage problem, because reducing applied power may also decrease the effectiveness of the probe in cleaning the wafer.

The most wafer damage appears to result from waves that strike the wafer at a ninety-degree angle. But these waves do not necessarily clean the wafer any more effectively. Waves that strike the wafer at more shallow angles still provide effective cleaning. Therefore, a modification to the device of the '744 patent that reduces the number of normal waves without significantly reducing the number of more shallow waves would reduce the incidence of wafer damage without compromising the cleaning ability of the device.

SUMMARY OF THE INVENTION

Preferred embodiments of the present apparatus and methods for reducing damage to substrates during megasonic cleaning processes have several features, no single one of which is solely responsible for their desirable attributes. Without limiting the scope of the present apparatus and methods, as expressed by the claims that follow, their more prominent features will now be discussed briefly. After considering this discussion, and particularly after reading the section entitled "Detailed Description of the Drawings," one will understand how the features of the present apparatus and methods provide advantages, which include efficient cleaning of wafers with minimal or no damage to the wafers.

A preferred embodiment of the present apparatus and methods for reducing damage to substrates during megasonic cleaning processes comprises an assembly for cleaning a thin, flat substrate. The assembly comprises a support for engaging a thin, flat substrate, the substrate having at least a first surface. A liquid engages the first surface. The assembly further comprises at least a first source of sonic energy, and at least a first sonic energy transmitter spaced from the substrate but in contact with the liquid. The first source applies sonic energy to the transmitter, and the transmitter transmits the sonic energy to the substrate first surface through the liquid. The transmitter attenuates the sonic energy to reduce the number of sonic waves that strike the substrate at or near a ninety-degree angle.

Another preferred embodiment of the present apparatus and methods comprises an apparatus for cleaning a thin, flat substrate. The apparatus comprises a support supporting the substrate in a generally horizontal orientation. The apparatus further comprises means for applying a thin film of liquid to a first surface of the substrate, and a sonic energy transmitter. The transmitter transmits sonic energy to the substrate first surface, and the transmitter attenuates the sonic energy to reduce the number of sonic waves that strike the substrate at or near a ninety-degree angle.

Another preferred embodiment of the present apparatus and methods comprises apparatus for cleaning a thin article having at least a first substantially planar surface. The apparatus comprises a support for the article, and a source of fluid for applying fluid to the first surface. The apparatus further comprises a transmitter configured to vibrate so as to transmit sonic energy through the fluid to the first surface to loosen particles on the first surface. A transducer vibrates the transmitter. The apparatus further comprises a wall with an opening therein through which gas is introduced to flow in contact with the transducer. The transmitter attenuates the sonic energy to reduce the number of sonic waves that strike the article at or near a ninety-degree angle.

Another preferred embodiment of the present apparatus and methods comprises a method of cleaning a thin, flat substrate. The method comprises the step of supporting a thin, flat substrate, the substrate having at least a first surface. The method comprises the steps of applying a liquid to the first surface, providing at least a first source of sonic energy, providing at least a first sonic energy transmitter spaced from the substrate but in contact with the liquid, energizing the first source of sonic energy, thereby applying sonic energy to the transmitter, transmitting sonic energy through the transmitter to the substrate first surface through the liquid, and attenuating the sonic energy to reduce the number of sonic waves that strike the substrate at or near a ninety-degree angle.

DETAILED DESCRIPTION OF THE PREFERRED EMBODIMENTS

Figure 1:
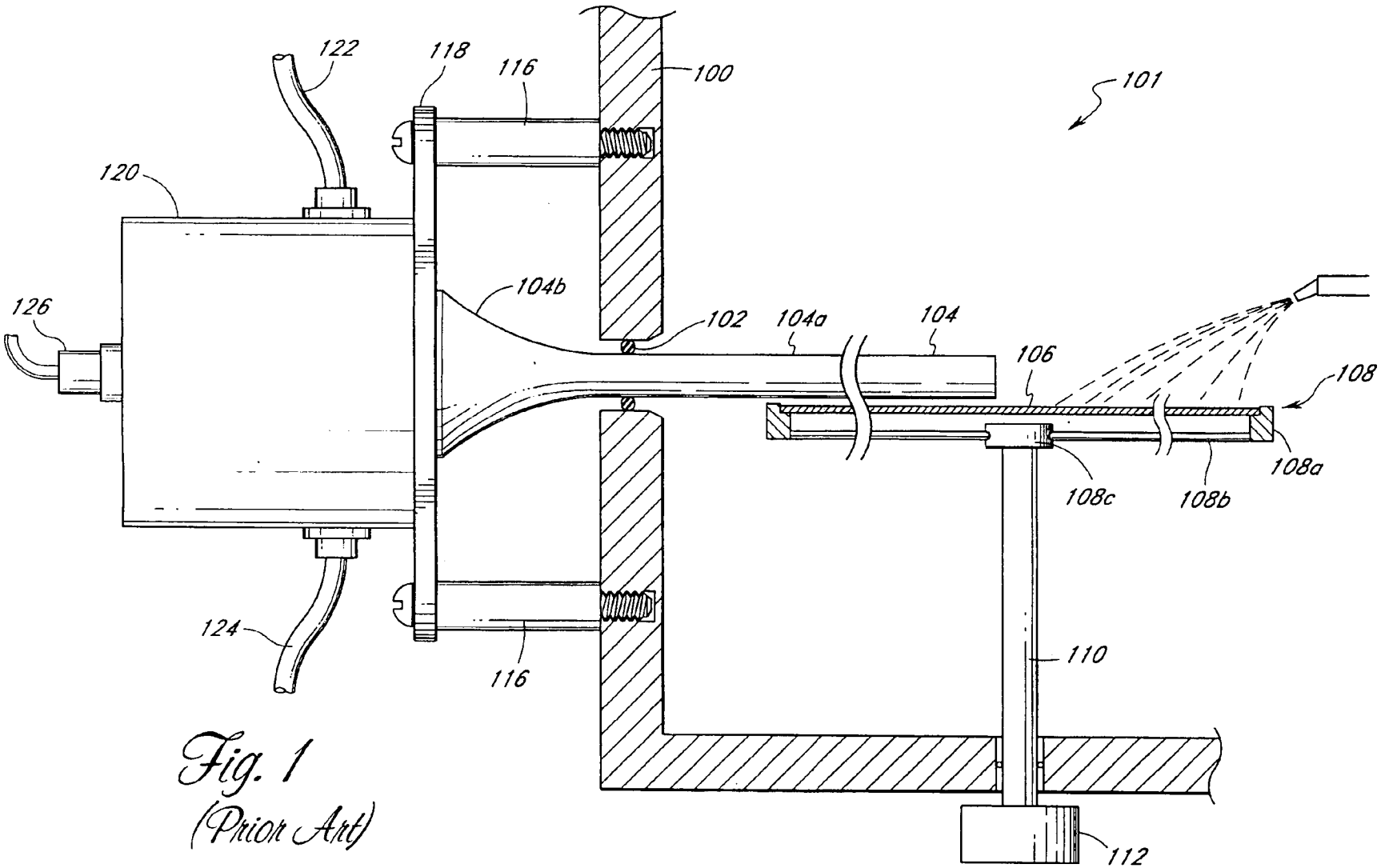
Fig. 1 (Prior Art)
FIG. 1 is a left-side elevation view of a prior art megasonic energy cleaning system.
Figure 2:
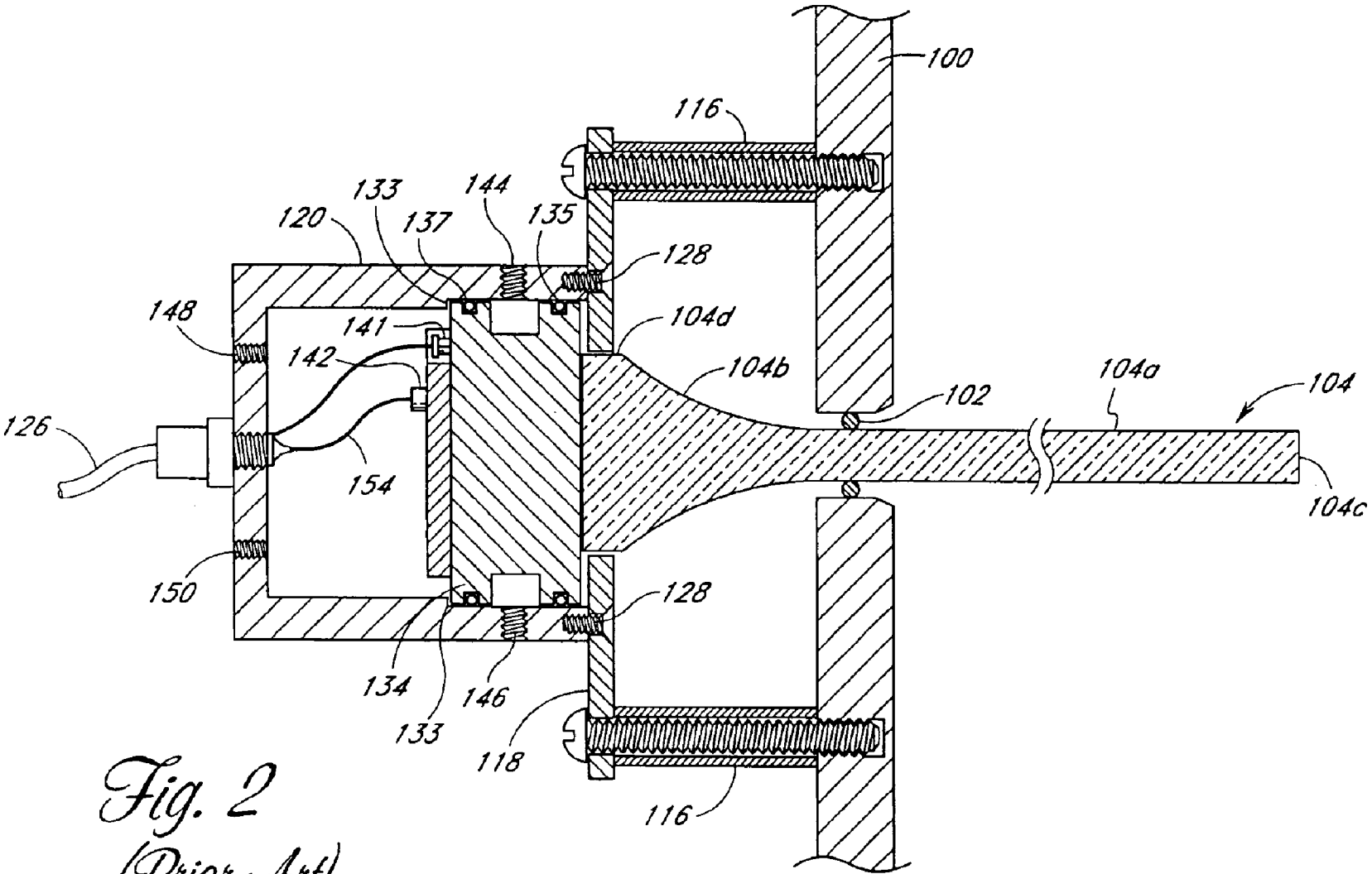
Fig. 2 (Prior Art)
FIG. 2 is a left-side cross-sectional view of the system shown in FIG. 1.
Figure 3:
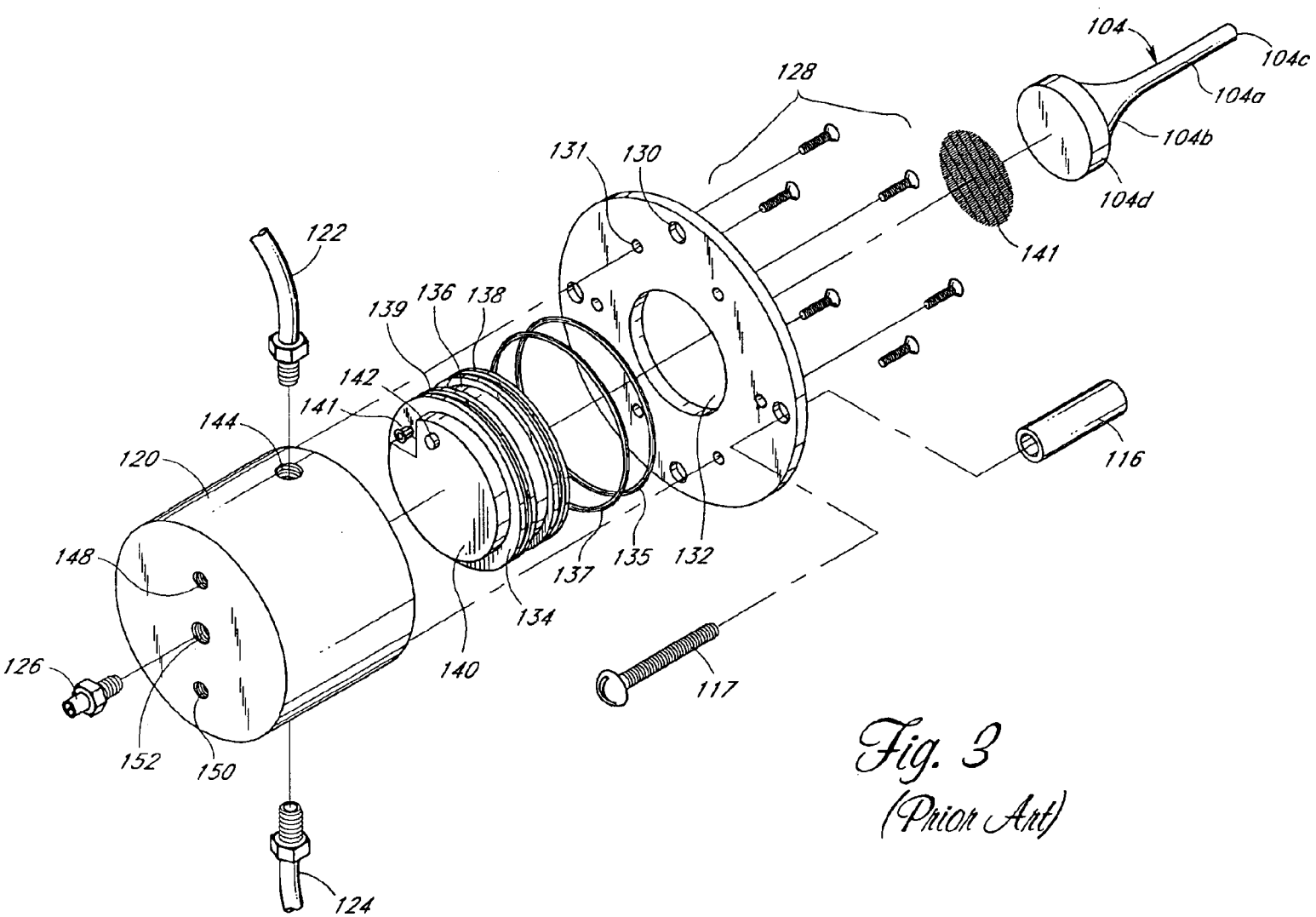
Fig. 3 (Prior Art)
FIG. 3 is an exploded perspective view of the probe assembly shown in FIG. 1.

FIGS. 1–3 illustrate a megasonic energy cleaning apparatus, made in accordance with the '744 patent, with an elongated probe 104 inserted through the wall 100 of a processing tank 101. As seen, the probe 104 is supported on one end outside the container 101. A suitable O-ring 102, sandwiched between the probe 104 and the tank wall 100, provides a proper seal for the processing tank 101. In another arrangement in the above cited patent, the liquid is sprayed onto the substrate, and the tank merely confines the spray. The probe is not sealed to the tank. A heat transfer member 134, contained within a housing 120, is acoustically and mechanically coupled to the probe 104. Also contained within the housing 120 is a piezoelectric transducer 140 acoustically coupled to the heat transfer member 134. Stand off 141, and electrical connectors 142, 154, and 126 are connected between the transducer 140 and a source of acoustic energy (not shown).

The housing 120 supports an inlet conduit 124 and an outlet conduit 122 for coolant and has an opening 152 for electrical connectors 154, and 126. The housing 120 is closed by an annular plate 118 with an opening 132 for the probe 104. The plate 118 in turn is attached to the tank 101.

Within the processing tank 101, a support or susceptor 108 is positioned parallel to and in close proximity to the probe 104. The susceptor 108 may take various forms, the arrangement illustrated including an outer rim 108*a* supported by a plurality of spokes 108*b* connected to a hub 108*c* supported on a shaft 110, which extends through a bottom wall of the processing tank 101. Outside the tank 101, the shaft 110 is connected to a motor 112.

The elongated probe 104 is preferably made of a relatively inert, non-contaminating material, such as quartz, which efficiently transmits acoustic energy. While utilizing a quartz probe is satisfactory for most cleaning solutions, solutions containing hydrofluoric acid can etch quartz. Thus, a probe made of sapphire silicon carbide, boron nitride, vitreous carbon, glassy carbon coated graphite, or other suitable materials may be employed instead of quartz. Also, quartz may be coated by a material that can withstand HF such as silicon carbide or vitreous carbon.

The probe 104 comprises a solid, elongated, spindle-like or probe-like cleaning portion 104*a*, and a base or rear portion 104*b*. The cross-section of the probe 104 may be round and advantageously, the diameter of the cleaning portion 104*a* is smaller in diameter than the rear portion 104*b*. In a preferred embodiment the area of the rear face of the rear portion 104*b* is 25 times that of the tip face of portion 104*a*. Of course, cross-sectional shapes other than circular may be employed.

A cylindrically-shaped rod or cleaning portion 104*a* having a small diameter is desirable to concentrate the megasonic energy along the length of the probe 104*a*. The diameter of the rod 104*a*, however, should be sufficient to withstand mechanical vibration produced by the megasonic energy transmitted by the probe. Preferably, the radius of the rod 104*a* should be equal to or smaller than the wavelength of the frequency of the energy applied to it. This structure produces a desired standing surface wave action that directs energy radially into liquid contacting the probe. In effect, the rod diameter is expanding and contracting a minute amount at spaced locations along the length of the rod. In a preferred embodiment, the radius of the rod 104*a* is approximately 0.2 inches and operates at a wave length of about 0.28 inches. This configuration produces 3 to 4 wave lengths per inch along the probe length.

The probe cleaning portion 104*a* is preferably long enough so that the entire surface area of the wafer 106 is exposed to the probe 104 during wafer cleaning. In a preferred embodiment, because the wafer is rotated beneath the probe 104, the length of the cleaning portion 104*b* is preferably long enough to reach at least the center of the wafer 106. Therefore, as the wafer 106 is rotated beneath the probe 104, the entire surface area of the wafer 106 passes beneath the probe 104. The probe 104 could probably function satisfactorily even if it does not reach the center of the wafer 106 since megasonic vibration from the probe tip would provide some agitation toward the wafer center.

The length of the probe 104 is also determined by a desired number of wavelengths. Usually, probe lengths vary in increments of half wavelengths of the energy applied to the probe 104. Preferably the probe cleaning portion 104*a* includes three to four wavelengths per inch of the applied energy. In this embodiment, the length of the probe cleaning portion 104*a* in inches is equal to the desired number of wavelengths divided by a number between three and four. Due to variations in transducers, it is necessary to tune the transducer 140 to obtain the desired wavelength, so that it works at its most efficient point.

The rear probe portion 104*b*, which is positioned outside the tank 101, flares to a diameter larger than the diameter of the cleaning portion 104*a*. In the embodiment shown in FIGS. 1–3, the diameter of the rear portion of the probe gradually increases to a cylindrical section 104*d*. The large surface area at the end of the rear portion 104*d* is advantageous for transmitting a large amount of megasonic energy, which is then concentrated in the smaller diameter section 104*a*.

The probe base 104*d* is acoustically coupled to a heat transfer member 134, which physically supports the probe 104. The probe end face is preferably bonded or glued to the support by a suitable adhesive material. In addition to the bonding material, a thin metal screen 141, shown in FIG. 3, is sandwiched between the probe end and the member 134. The screen 141 with its small holes filled with adhesive provides a more permanent vibration connection than that obtained with the adhesive by itself. The screen utilized in a prototype arrangement was of the expanded metal type, about 0.002 inches thick with flattened strands defining pockets between strands capturing the adhesive. As another alternative, the screen 141 may be made of a beryllium copper, about 0.001 inches thick, made by various companies using chemical milling-processes. The adhesive employed was purchased from E.V. Roberts in Los Angeles and formed by a resin identified as number 5000, and a hardener identified as number 61. The screen material is sold by a U.S. company, Delkar.

The probe 104 can possibly be clamped or otherwise coupled to the heat transfer member 134 so long as the probe 104 is adequately physically supported and megasonic energy is efficiently transmitted to the probe 104.

The heat transfer member 134 is made of aluminum, or some other good conductor of heat and megasonic energy. In the arrangement illustrated, the heat transfer member 134 is cylindrical and has an annular groove 136, which serves as a coolant duct large enough to provide an adequate amount of coolant to suitably cool the apparatus. Smaller annular grooves 138, 139 on both sides of the coolant groove 136 are fitted with suitable seals, such as O-rings 135, 137 to isolate the coolant and prevent it from interfering with the electrical connections to the transducer 140.

The transducer 140 is bonded, glued, or otherwise acoustically coupled to the rear flat surface of the heat transfer member 134. A suitable bonding material is that identified as ECF 558, available from Ablestick of Rancho Dominguez, Calif. The transducer 140 is preferably disc shaped and has a diameter larger than the diameter of the rear end of the probe section 104*d* to maximize transfer of acoustic energy from the transducer 140 to the probe 104. The heat transfer member 134 is preferably gold-plated to prevent oxidizing of the aluminum, thereby providing better bonding with both the transducer 140 and the probe 104. The member 134 should have an axial thickness that is approximately equal to an even number of wave lengths or half wave lengths of the energy to be applied to the probe 104.

The transducer 140 and the heat transfer member 134 are both contained within the housing 120 that is preferably cylindrical in shape. The heat transfer member 134 is captured within an annular recess 133 in an inner wall of the housing 120.

The housing 120 is preferably made of aluminum to facilitate heat transfer to the coolant. The housing 120 has openings 144 and 146 for the outlet conduit 122 and the inlet conduit 124 for the liquid coolant. The housing 120 has an opening 152 in FIG. 3 for the electrical connections 126 and 154, seen in FIG. 2. Openings 148, 150 allow a gaseous purge to enter and exit the housing 120.

An open end of the housing 120 is attached to the annular plate 118 having the central opening 132 through which extends the probe rear section 104*d*. The annular plate 118 has an outer diameter extending beyond the housing 120 and has a plurality of holes organized in two rings through an inner ring of holes 131, a plurality of connectors 128, such as screws, extend to attach the plate 118 to the housing 120. The annular plate 118 is mounted to the tank wall 100 by a plurality of threaded fasteners 117 that extend through the outer ring of plate holes 130 and thread into the tank wall 100. The fasteners 117 also extend through sleeves or spacers 116 that space the plate 118 from the tank wall 100. The spacers 116 position the transducer 140 and flared rear portion 104*b* of the probe outside the tank 101 so that only the cleaning portion of the probe 104 extends into the tank. Also, the spacers 116 isolate the plate 118 and the housing 120 from the tank 101 somewhat, so that vibration from the heat transfer member 134, the housing 120 and the plate 118 to the wall 100 is minimized.

The processing tank 101 is made of material that does not contaminate the wafer 106. The tank 101 should have an inlet (not shown) for introducing fluid into the tank 101 and an outlet (not shown) to carry away particles removed from the wafer 106.

As the size of semiconductor wafers increases, rather than cleaning a cassette of wafers at once, it is more practical and less expensive to use a cleaning apparatus and method that cleans one wafer at a time. Advantageously, the size of the probe 104 may vary in length depending on the size of the wafer to be cleaned.

A semiconductor wafer 106 or other article to be cleaned is placed on the support 108 within the tank 101. The wafer 106 is positioned sufficiently close to the probe 104 so that the agitation of the fluid between the probe 104 and the wafer 106 loosens particles on the surface of the wafer 106. Preferably, the distance between the probe 104 and the surface of the wafer 106 is no greater than about 0.1 inches.

The motor 112 rotates the support 108 beneath the probe 104 so that the entire upper surface of the wafer 106 is sufficiently close to the vibrating probe 104 to remove particles from the wafer surface. The rotation speed will vary depending upon the wafer size. For a 5" diameter wafer, however, preferred rotation speeds are from 5 to 30 revolutions per minute, and more preferably from 15 to 20 rpm.

As might be expected, longer cleaning times produce cleaner wafers. However, shorter cleaning times increase throughput, thereby increasing productivity. Preferred cleaning times with preferred embodiments of the megasonic probe energy attenuator are from 5 seconds to 3 minutes, and more preferably from 15 seconds to 1 minute.

When the piezoelectric transducer 140 is electrically excited, it vibrates at a high frequency. Preferably the transducer 140 is energized at megasonic frequencies with the desired wattage consistent with the probe size and work to be performed. The vibration is transmitted through the heat transfer member 134 and to the elongated probe 104. The probe 104 then transmits the high frequency energy in transverse waves into cleaning fluid between the probe 104 and the wafer 106. One of the significant advantages of the arrangement is that the large rear probe portion 104*d* can accommodate a large transducer 140, and the smaller forward probe portion 104*a* concentrates the megasonic vibration into a small area so as to maximize particle loosening capability. Sufficient fluid between the probe 104 and the wafer 106 effectively transmits the energy across the small gap between the probe 104 and the wafer 106 to produce the desired cleaning. As each area of the wafer 106 approaches and passes the probe 104, the agitation of the fluid between the probe 104 and the wafer 106 loosens particles on the semiconductor wafer 106. Contaminants are thus vibrated away from the wafer surface. The loosened particles may be carried away by a continuous fluid flow.

Applying significant wattage to the transducer 140 generates considerable heat, which could damage the transducer 140. Therefore, coolant is pumped through the housing 120 to cool the member 134 and, hence, the transducer 134.

A first coolant, preferably a liquid such as water, is introduced into one side of the housing 120, circulates around the heat transfer member 134 and exits the opposite end of the housing 120. Because the heat transfer member 134 has good thermal conductivity, significant quantities of heat may be easily conducted away by the liquid coolant. The rate of cooling can, of course, be readily altered by changing the flow rate and/or temperature of the coolant.

A second, optional, coolant circulates over the transducer 140 by entering and exiting the housing 120 through openings 148, 150 on the closed end of the housing 120, or through a single opening. Due to the presence of the transducer 140 and the electrical wiring 154, an inert gas such as nitrogen is used as a coolant or as a purging gas in this portion of the housing 120.

In use, deionized water or other cleaning solution may be sprayed onto the wafer upper surface from a nozzle 214 while the probe 104 is acoustically energized. As an alternative to spraying the cleaning solution onto the wafer 106 from a nozzle, the tank 101 may be filled with cleaning solution. In the spray-on method, the liquid creates a meniscus 216 between the lower portion of the probe 104 and the adjacent upper surface of the rotating wafer 106. The meniscus 216, schematically illustrated in FIG. 4, wets a lower portion of the probe cross section. The size of the arc defined by the wetted portion of the cross-section varies according to the properties of the liquid used in the cleaning solution, the material used to construct the probe 104, and the vertical distance between the wafer 106 and the lower edge of the probe 104. The vertical distance between the wafer 106 and the lower edge of the probe 104 is preferably about one-half of the wavelength of the sonic energy in the cleaning solution. Using deionized water as the cleaning solution, a quartz probe 104, and a distance of 0.070" between the wafer 106 and the lower edge of the probe 104, the arc defined by the wetted portion of the probe cross-section is preferably about 90°.

The cleaning solution provides a medium through which the megasonic energy within the probe 104 is transmitted to the wafer surface to loosen particles. These loosened particles are flushed away by the continuously flowing spray and the rotating wafer 106. When the liquid flow is interrupted, a certain amount of drying action is obtained through centrifugal force, with the liquid being thrown from the wafer 106.

Because the components present on a typical silicon wafer are rather delicate, care must be taken during the cleaning process to ensure that none of these components are damaged. As the amount of power applied to the probe 104 is increased, the amount of energy transferred from the probe 104 to the cleaning solution is increased, and the amount of energy transferred from the cleaning solution to the wafer 106 is also increased. As a general rule, the greater the power applied to the wafer 106, the greater the potential for wafer damage. Thus, one method of decreasing wafer damage is to decrease the power supplied to the transducer 140, thereby limiting the power transmitted to the probe 104.

Figure 4:
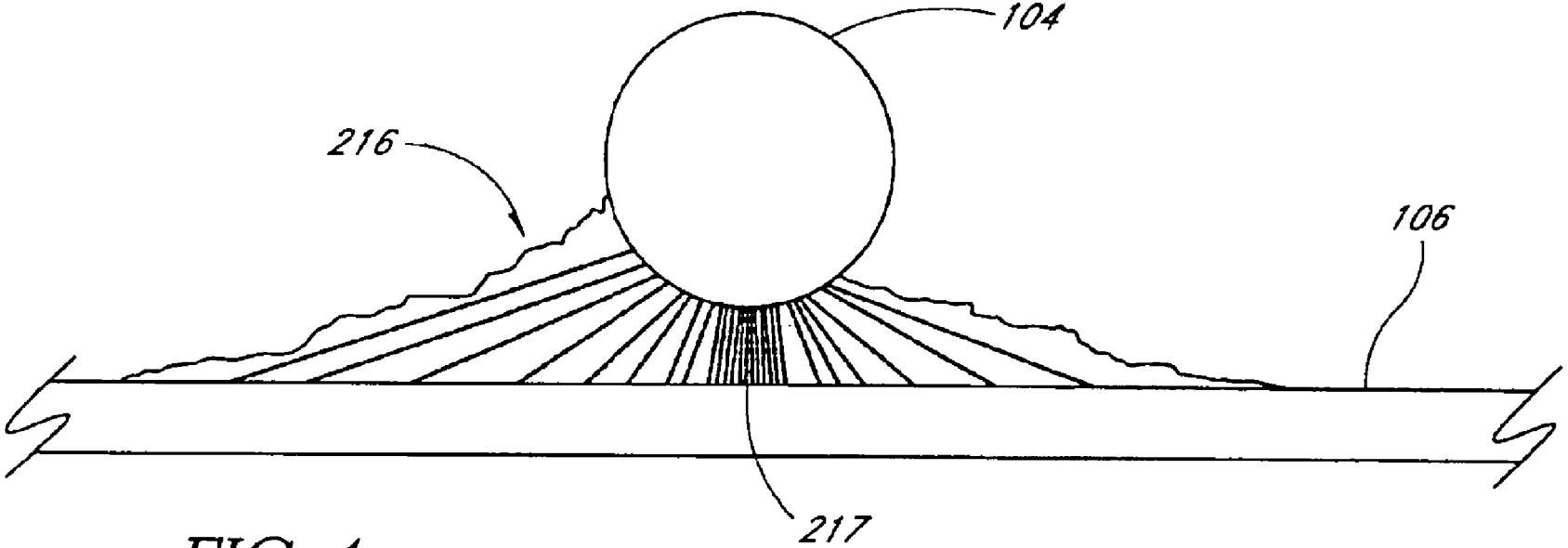
FIG. 4 (PRIOR ART)
FIG. 4 is a front schematic view of the probe of FIG. 1, illustrating the formation of a liquid meniscus between the probe and a silicon wafer.

As illustrated schematically in FIG. 4, the zone 217 of greatest wafer damage is directly beneath the center of the cylindrical probe 104. The radial pattern of sonic wave emission from the probe 104 produces this wafer damage pattern. For a circular probe cross-section, waves emanate radially from all points on the circle at the transverse expansion areas. Therefore, waves emanating from near the bottom of the circle strike the wafer surface at or near a ninety-degree angle. These normal-incident waves strike the wafer surface with the greatest intensity, because their energy is spread out over a minimal area. The concentration of energy in a relatively small area can damage delicate components on the wafer surface.

Waves emanating from points along the circle that are spaced from the bottom strike the wafer surface at more shallow angles. The energy transferred to the wafer by these waves is less intense than the energy transferred by waves that emanate from at or near the bottom, because the energy from these waves is spread over a larger area. For each wave, the further from the bottom of the circle it emanates, the more shallow is the angle at which it strikes the wafer surface and, hence, the less intense is the energy transferred to the wafer 106.

These shallow-angle waves generally provide sufficient intensity to effectively clean the wafer surface without causing the damage that is characteristic of normal-incident waves. Thus, one preferred embodiment of the megasonic probe energy attenuator provides a probe 104 that increases the motion produced by the shallow-angle waves to that produced by the normal incident waves as compared to a probe 104 having a circular cross-section.

Figure 5B:
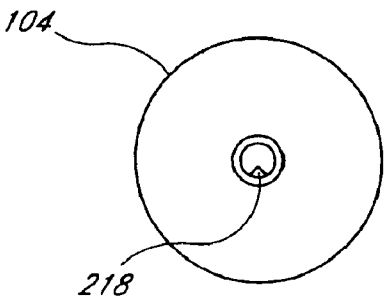
FIG. 5*b* is a front elevation view of the megasonic probe of FIG. 5*a;*
Figure 5A:
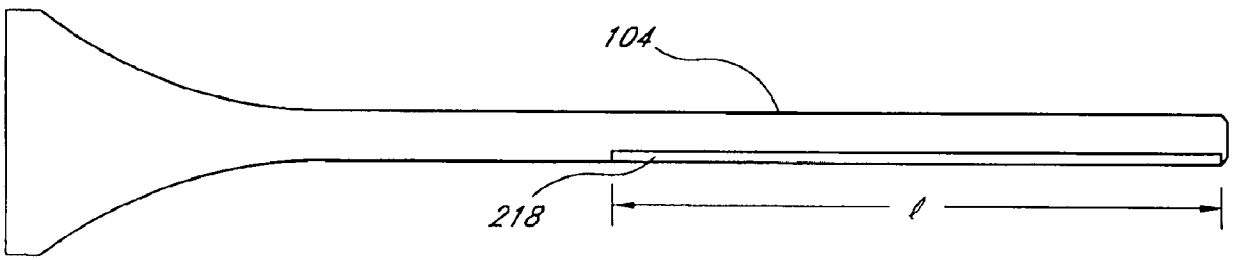
FIG. 5*a* is a left-side elevation view of a preferred embodiment of a megasonic probe that effectively reduces damage to substrates during megasonic cleaning processes.
Figure 6C:
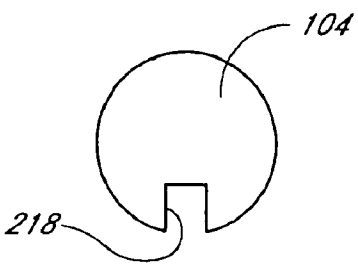
FIGS. 6*a*–6*g* are front views of preferred cross-sectional shapes for the megasonic probe of FIG. 5*a;*
Figure 6A:
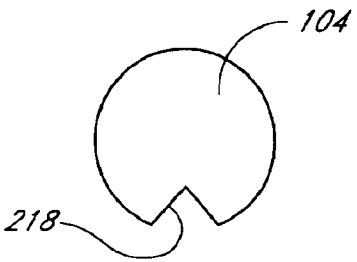
Figure 6B:
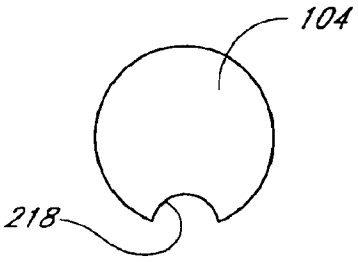

One preferred method of increasing this ratio is to provide a probe 104 having a cross-section that is not completely circular. This may be done by creating a channel 218 in the underside of the probe 104, as shown in FIGS. 5*a*–5*b*. The probe cross-section thus is substantially circular but with a cutout in the lower portion, the cutout defining the channel 218 extending along a portion of the probe lower edge. FIGS. 6*a*–6*c* illustrate preferred shapes for the channel-cut. It will be understood by one skilled in the art that other channel shapes are possible, and the pictured examples are in no way intended to limit the scope of coverage.

The channel 218 is preferably centered on the lower portion of the probe 104, beginning at the free end of the probe 104 and terminating at a distance l from this end. The distance l is preferably equal to or greater than the radius of the wafer 106. Thus, with the free end of the probe 104 located directly above the wafer center, the channel 218 extends at least as far as the wafer edge. The width of each channel 218 is preferably about 2 millimeters, although a wide range of widths would be satisfactory.

During the cleaning process, the cleaning solution fails to wet the entire lower surface of the channel-cut probe 104. Instead, a pocket of air is trapped in the upper portion of the channel 218. The transmission efficiency at the probe-air interface is extremely low as compared to the probe-liquid interface. Thus, megasonic energy that would otherwise emanate from the upper portions of the channel 218 is prevented from doing so by the lack of liquid there. The pattern of wave emission for each channel-cut probe 104 is thus different from the standard radial pattern generated by the circular cross-section probe 104. The important consequence of this altered pattern is that the particle loosening activity produced by normal-incident waves is reduced, and so is the wafer damage associated therewith. Wafer cleaning, however, remains satisfactory.

Figure 6G:
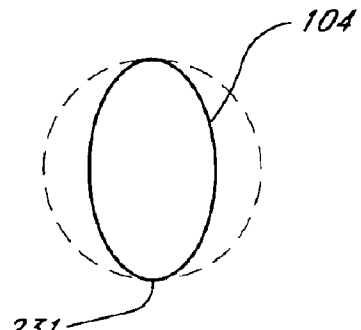
Figure 6F:
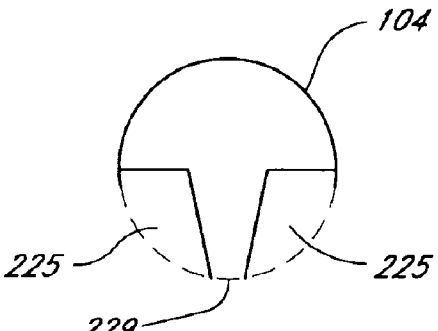
Figure 6D:
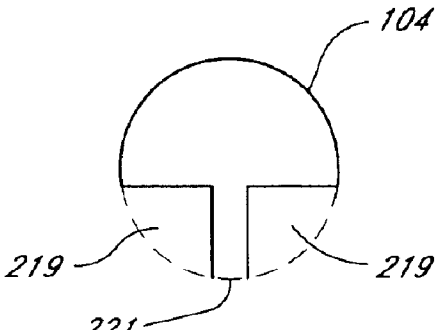
Figure 6E:
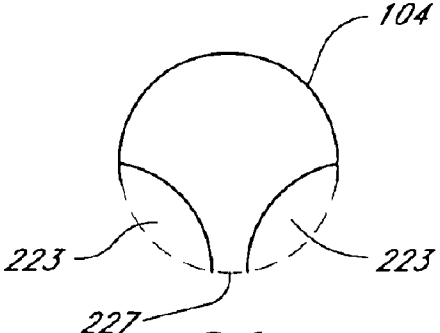

Another group of preferred probe cross-sectional shapes is illustrated in FIGS. 6*d*–6*g*. The shapes of FIGS. 6*d*–6*f* include cutouts 219, 223, 225 on either side of a lower edge 221, 227, 229 and thus are substantially similar to a "T", with the lower edge of the probe 104 being very narrow as compared to the upper portion. The shapes of the cutouts in FIGS. 6*d*–6*f* are pie-shaped 219, elliptical 223 and crooked pie-shaped 225.

The shape of FIG. 6*g* is substantially elliptical, with a long axis of the ellipse being oriented vertically, and a short axis horizontally. A narrowest portion 231 of the ellipse cross-section thus forms a lower edge of the probe 104. As with the channel-cut cross-sections just described, the pattern of megasonic wave emission from probes 104 having these cross-sections varies from the standard radial pattern produced by the circular cross-section probe 104. Specifically, these cross-sections reduce the ratio of normal-incident waves to shallow-angle waves. This reduced ratio decreases wafer damage without significantly affecting wafer cleaning efficiency.

In an alternative embodiment, the probe 104 having an elliptical cross-section, shown in FIG. 6*g*, is oriented with its major axis horizontal and its minor axis vertical. In this configuration, the ratio of normal-incident waves to shallow-angle waves is increased. The cleaning power of the probe 104 is thus increased.

Figure 7A:
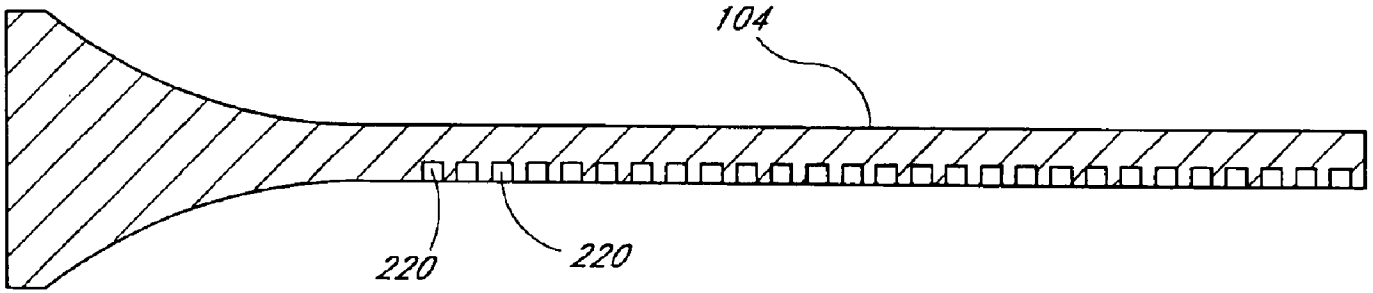
FIG. 7*a* is a left-side cross-sectional view of another preferred embodiment of a megasonic probe that effectively reduces damage to substrates during megasonic cleaning processes.
Figure 7B:
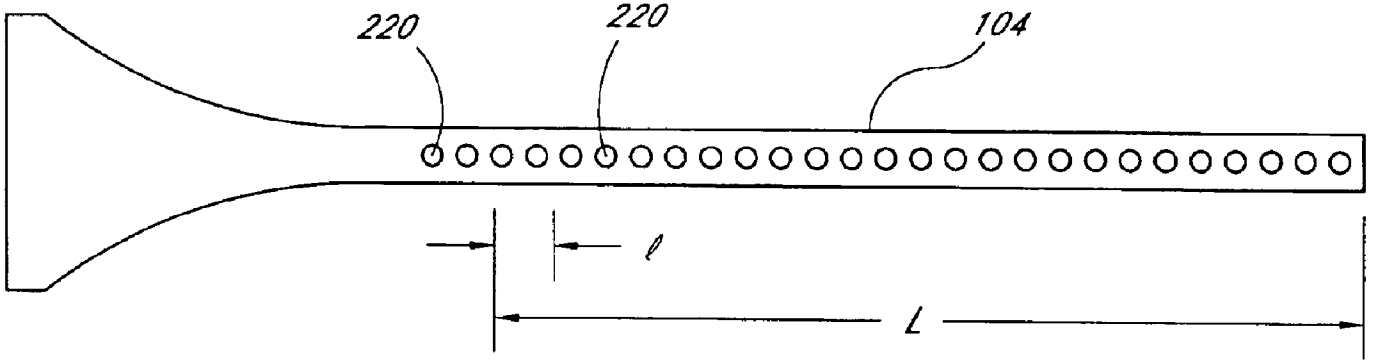
FIG. 7*b* is a bottom plan view of the megasonic probe of FIG. 7*a*.

A most preferred probe shape is illustrated in FIGS. 7*a*–7*b*. The cleaning portion of this probe 104 is substantially cylindrical with a number of transverse bores 220 in the lower portion, the bores 220 extending from near the free end of the probe 104 toward the fixed end. The bores 220 are substantially the same diameter and depth, extending less than half-way through the probe 104. The wavelength of the megasonic energy in the probe preferably determines the longitudinal spacing of the bores 220. In a preferred embodiment, the longitudinal distance between a center of one bore 220 and a center of a neighboring bore 220 is equal to one wavelength of the megasonic energy.

The bores 220 in fact are a series of resonator cells. Due to multiple reflection of sound at the interfaces between quartz and liquid, these cells dissipate sound energy within a certain bandwidth. The bores 220 thus act as a sort of bandwidth filter. The frequency range, and the amount of sound energy in this frequency range, to be isolated determines the diameter and depth of the bores 220. In addition, as with the channels 218 in the channel-cut probes 104, the bores 220 of this configuration trap air inside them. The trapped air alters the pattern of wave emission, reducing the ratio of normal-incident waves to shallow-angle waves. As described above, this alteration reduces wafer damage.

Another preferred method of decreasing wafer damage while maintaining cleaning efficiency is to provide a probe 104 having a roughened surface at the probe-liquid interface. The probe surface may be roughened by sandblasting or chemical etching, for example. With a quartz probe, hydrofluoric acid works particularly well for etching. The roughening decreases the transmission efficiency at the probe-liquid interface, thereby decreasing the energy carried by the megasonic waves that strike the wafer upper surface.

Either the entire surface that forms the probe-liquid interface may be roughened, or only select portions of this surface may be roughened. One preferred embodiment provides a probe 104 having a thin roughened strip along a central portion of the probe lower edge, with the balance of the probe surface being substantially smooth. It will be understood by one of skill in the art that surface roughening may be employed with probes of any cross-sectional shape, including those described above and others.

SCOPE OF THE INVENTION

The above presents a description of the best mode contemplated for the megasonic probe energy attenuator, and of the manner and process of making and using it, in such full, clear, concise, and exact terms as to enable any person skilled in the art to which it pertains to make and use this megasonic probe energy attenuator. This megasonic probe energy attenuator is, however, susceptible to modifications and alternate constructions from that discussed above which are fully equivalent. Consequently, it is not the intention to limit this megasonic probe energy attenuator to the particular embodiments disclosed. On the contrary, the intention is to cover all modifications and alternate constructions coming within the spirit and scope of the megasonic probe energy attenuator as generally expressed by the following claims, which particularly point out and distinctly claim the subject matter of the megasonic probe energy attenuator.

What is claimed is:

1. An assembly for cleaning a thin, flat substrate, the assembly comprising:

a support for engaging a thin, flat substrate, the substrate having at least a first surface;

a liquid engaging the first surface;

at least a first source of sonic energy; and at least a first sonic energy transmitter spaced from the substrate but in contact with the liquid;

wherein the first source applies sonic energy to the transmitter, and the transmitter transmits the sonic energy to the substrate first surface, and the transmitter attenuates the sonic energy to reduce the number of sonic waves that strike the substrate at or near a ninety degree angle, wherein the transmitter includes one or more features selected from the group consisting of a substantially elliptical cross section, a roughened surface, and a plurality of bores.

2. The assembly of claim 1, wherein the support engages a periphery of the substrate.

3. The assembly of claim 1, wherein the support supports the substrate in a substantially horizontal orientation.

4. The assembly of claim 1, wherein the support is rotatable.

5. The assembly of claim 1, further comprising a first source of liquid, wherein the first source of liquid applies the liquid to the substrate first surface.

6. The assembly of claim 1 further comprising a sprayer for supplying liquid to the substrate first surface.

7. The assembly of claim 1, wherein the first source of sonic energy comprises a transducer.

8. The assembly of claim 7, wherein the transducer is coupled to the transmitter.

9. The apparatus of claim 1 wherein:

the support supports the substrate in a generally horizontal orientation;

further including means for applying a thin film of liquid to a first surface of the substrate.

10. The apparatus of claim 9, wherein the transmitter transmits sonic energy to the substrate first surface through the liquid.

11. The apparatus of claim 9, wherein the substrate first surface is a top surface.

12. The apparatus of claim 9, wherein the substrate is a semiconductor wafer.

13. The assembly of claim 9, wherein the support is rotatable.

14. The apparatus of claim 9, wherein the means for applying a thin film of liquid comprises a sprayer.

15. The apparatus of claim 9, wherein the sonic energy transmitter comprises an elongate probe.

16. The apparatus of claim 9, wherein the transmitter is formed of quartz, sapphire, silicon carbide, silicon nitride, quartz coated with silicon carbide or quartz coated with vitreous carbon.

17. The apparatus of claim 9, further comprising a source of sonic energy coupled to the transmitter.

18. The apparatus of claim 17, wherein the source of sonic energy is a transducer.

19. An assembly for cleaning a thin, flat substrate, the assembly comprising:

a support for engaging a thin, flat substrate, the substrate having at least a first surface;

a liquid engaging the first surface;

at least a first source of sonic energy;

at least a first sonic energy transmitter spaced from the substrate but in contact with the liquid;

wherein the first source applies sonic energy to the transmitter, and the transmitter transmits the sonic energy to the substrate first surface, and the transmitter attenuates the sonic energy to reduce the number of sonic waves that strike the substrate at or near a ninety degree angle; and wherein the first sonic energy transmitter comprises an elongate probe.

20. The assembly of claim 19, wherein the probe extends generally parallel to the substrate first surface.

21. The assembly of claim 19, wherein a portion of the probe directly adjacent to the substrate is configured to reduce a ratio of normal incident waves to shallow angle waves.

22. The assembly of claim 19, wherein a portion of the probe directly adjacent the substrate first surface includes a substantially elliptical cross section.

23. The assembly of claim 19, wherein a portion of the probe directly adjacent the substrate first surface includes an elongate channel.

24. The assembly of claim 19, wherein a portion of the probe includes elongate cutouts that create a narrow edge of the probe, the edge lying directly adjacent the substrate first surface.

25. The assembly of claim 19, wherein a portion of the probe directly adjacent the substrate first surface includes a roughened surface.

26. The assembly of claim 19, wherein a portion of the probe directly adjacent the substrate first surface includes a plurality of bores.

27. Apparatus for cleaning a thin article having at least a first substantially planar surface, the apparatus comprising:

a support for the article;

a source of fluid for applying fluid to the first surface;

a transmitter configured to vibrate so as to transmit sonic energy through the fluid to the first surface to loosen particles on the first surface;

a transducer for vibrating the transmitter; and a wall with an opening therein through which gas is introduced to flow in contact with the transducer;

wherein the transmitter includes one or more features selected from the group consisting of a substantially elliptical cross section, a roughened surface, and a plurality of bores; and the transmitter attenuates the sonic energy to reduce the number of sonic waves that strike the article at or near a ninety degree angle.

28. The apparatus of claim 27, wherein the article is supported in a substantially horizontal orientation.

29. The apparatus of claim 27, wherein the article comprises a semiconductor wafer.

30. The apparatus of claim 27, further comprising a sprayer for supplying liquid to the substrate first surface.

31. The apparatus of claim 27, wherein the wall forms a part of an enclosure, and the enclosure creates a space surrounding the transducer, and the opening introduces gas into the space.

32. The apparatus of claim 31, wherein the gas purges the space.

33. The apparatus of claim 31, wherein the gas cools the transducer.

34. A method of cleaning a thin, flat substrate, the method comprising the steps of:

supporting a thin, flat substrate, the substrate having at least a first surface;

applying a liquid to the first surface;

providing at least a first source of sonic energy;

providing at least a first sonic energy transmitter spaced from the substrate but in contact with the liquid, the transmitter including one or more features selected from the group consisting of a substantially elliptical cross section, a roughened surface, and a plurality of bores;

energizing the first source of sonic energy, thereby applying sonic energy to the transmitter;

transmitting sonic energy through the transmitter to the substrate first surface through the liquid; and attenuating the sonic energy to reduce the number of sonic waves that strike the substrate at or near a ninety degree angle.

35. The method of claim 34, further comprising the step of supporting the substrate in a substantially horizontal orientation.

36. The method of claim 34, further comprising the step of rotating the substrate as the liquid and sonic energy are applied to the substrate first surface.

37. The method of claim 34, further comprising the step of spraying the liquid onto the substrate first surface.

38. The method of claim 34, further comprising the step of reducing a ratio of normal incident waves to shallow angle waves.

39. A method of cleaning a thin, flat substrate, the method comprising the steps of:

supporting a thin, flat substrate, the substrate having at least a first surface;

applying a liquid to the first surface;

providing at least a first source of sonic energy;

providing at least a first sonic energy transmitter spaced from the substrate but in contact with the liquid, the transmitter comprising an elongate probe;

energizing the first source of some energy, thereby applying sonic energy to the transmitter;

transmitting sonic energy through the transmitter to the substrate first surface through the liquid; and attenuating the sonic energy to reduce the number of sonic waves that strike the substrate at or near a ninety degree angle.

40. The method of claim 39 wherein the first source applies sonic energy to the transmitter, and the transmitter transmits the sonic energy to the substrate first surface, and the transmitter attenuates the sonic energy to reduce the number of sonic waves that strike the substrate at or near a ninety degree angle, wherein the transmitter includes one or more features selected from the group consisting of a substantially elliptical cross section, an elongate channel, elongate cutouts that create a narrow edge lying directly adjacent the substrate first surface, a roughened surface, and a plurality of bores.

* * * * *